US008205355B2

(12) United States Patent
Kawai

(10) Patent No.: US 8,205,355 B2
(45) Date of Patent: Jun. 26, 2012

(54) SOLE STRUCTURE FOR A SPORTS SHOE

(75) Inventor: Tatsuo Kawai, Aichi-gun (JP)

(73) Assignee: Mizuno Corporation, Osaka-shi (JP)

( * ) Notice: Subject to any disclaimer, the term of this patent is extended or adjusted under 35 U.S.C. 154(b) by 781 days.

(21) Appl. No.: 12/290,385

(22) Filed: Oct. 29, 2008

(65) Prior Publication Data

US 2009/0133290 A1 May 28, 2009

(30) Foreign Application Priority Data

Nov. 13, 2007 (JP) ..... 2007-294023

(51) Int. Cl.
*A43B 23/00* (2006.01)
*A43B 13/18* (2006.01)
*A43B 21/06* (2006.01)

(52) U.S. Cl. ..... 36/28; 36/35 R; 36/107

(58) Field of Classification Search ..... 36/105, 36/107, 30 R, 103, 37, 28, 35 R, 27
See application file for complete search history.

(56) References Cited

U.S. PATENT DOCUMENTS

| | | | | |
|---|---|---|---|---|
| 6,219,939 | B1 | 4/2001 | Kita et al. | |
| 6,314,664 | B1 | 11/2001 | Kita et al. | |
| 6,401,365 | B2 | 6/2002 | Kita et al. | |
| 6,487,796 | B1 * | 12/2002 | Avar et al. | 36/28 |
| 6,931,765 | B2 * | 8/2005 | Lucas et al. | 36/35 R |
| 7,441,346 | B2 * | 10/2008 | Hardy et al. | 36/25 R |
| 7,673,397 | B2 * | 3/2010 | Jarvis | 36/28 |
| 7,946,059 | B2 * | 5/2011 | Borel | 36/28 |
| 2006/0042120 | A1 * | 3/2006 | Sokolowski et al. | 36/29 |
| 2006/0137227 | A1 * | 6/2006 | Kita et al. | 36/102 |
| 2007/0193065 | A1 * | 8/2007 | Nishiwaki et al. | 36/27 |

FOREIGN PATENT DOCUMENTS

JP 11-203 1/1999

* cited by examiner

*Primary Examiner* — Khoa Huynh
*Assistant Examiner* — Melissa Lalli
(74) *Attorney, Agent, or Firm* — W. F. Fasse

(57) ABSTRACT

A sole structure for a sports shoe includes a wavy corrugated plate that is disposed at a heel region of the sole structure and that has corrugations around the heel circumferential portion. The amplitude or height of each corrugation becomes gradually greater toward the heel circumferential edge. The sole structure further includes pillar members formed of rubber and disposed around the heel circumferential portion on the bottom surface of the wavy corrugated plate. The top surfaces of the pillar members include inclined surfaces that slope downwardly as they progress outwardly from the heel central portion toward the heel circumferential edge.

22 Claims, 12 Drawing Sheets

SOLE STRUCTURE FOR A SPORTS SHOE

BACKGROUND OF THE INVENTION

The present invention relates generally to a sole structure for a sports shoe, and more particularly, to an improvement in the sole structure for achieving a lightweight and securing stability and enhancing resilience at the time of heel strike onto the ground.

Japanese patent application laying-open publication No. 11-203 shows a sole structure for a sports shoe having an upper midsole and a lower midsole that are disposed at the heel portion of the shoe and that are formed of soft elastic materials, and having a wavy corrugated sheet that is disposed between the upper midsole and the lower midsole.

In this case, since a midsole heel portion has the wavy corrugated sheet interposed thereinto, the midsole heel portion generates a resistance force to restrain a lateral deformation of the midsole heel portion at the time of heel strike onto the ground. Thereby, a lateral swing or leaning sideways of the sole heel portion is prevented and stability on heel striking onto the ground is secured.

However, in this case, the upper and lower midsoles of soft elastic materials are provided on the upper and lower sides of the wavy corrugated sheet. As a result, it has a deficiency that the weight of the entire sole structure becomes heavy.

On the other hand, U.S. Pat. No. 6,487,796 discloses a sole structure having a plurality of resilient support elements at the sole heel region. The top surfaces of the resilient support elements are inclined downwardly toward the heel central portion. Each of the resilient support elements has an indentation formed around the outer circumferential surface of the elements. That is, in this case, the height of each of the resilient support members is highest at the sole outer circumferential edge portion and gradually lowered toward the sole central portion and lowest at the innermost position of the sole (see FIGS. 6 and 7). Also, the indentation is formed at a position that causes the resilient support element to deform to fall toward the heel central portion when the compressive load is applied.

In this case, the sole structure is constructed by sandwiching the resilient support elements between the heel plate and the base without utilizing a relatively heavy soft elastic material, which makes it possible to decrease the weight of the entire sole structure. Also, U.S. Pat. No. '796 describes that since the periphery of the calcaneus of the foot of a wearer is supported at the lower-side inclined surface on the top surfaces of the resilient support elements a compressive force applied from the calcaneus at the time of impacting the ground on the heel causes the resilient support elements to deform toward the heel central portion thus improving the stability of the shoe in the lateral direction.

However, in the structure shown in U.S. Pat. No. '796, it is directed to achieving a lateral stability at the time of heel strike onto the ground by causing the resilient support elements to deform and fall toward the heel central portion at the time of heel strike onto the ground in such a way that the heel portion of the foot moves downwardly toward the intermediate regions between the resilient support elements. Therefore, it does not have a sufficient resilience as a sole heel region which is required from heel-in to heel-off.

An object of the present invention is to provide a sole structure for a sports shoe that is lighter in weight and that can secure stability and improve resilience at the time of heel strike onto the ground.

Other objects and advantages of the present invention will be apparent from the following description.

SUMMARY OF THE INVENTION

A sole structure for a sports shoe according to the present invention includes a wavy corrugated plate disposed at least at a heel region of the sole structure and having corrugations around a heel circumferential portion, and a plurality of pillar members formed of elastic materials and disposed around the heel circumferential portion on the lower surface of the wavy corrugated plate. Amplitudes of the corrugations of the wavy corrugated plate are gradually greater toward the heel circumferential edge side. The top surfaces of the pillar members are fixedly attached to the bottom surface of the wavy corrugated plate. The top surfaces of the pillar members have inclined surfaces whose heights from the bottom surfaces of the pillar members are gradually lowered toward the heel circumferential edge side.

In this case, since the bottom surface of the wavy corrugated plate is supported not by a midsole of soft elastic material attached to the entire bottom surface but rather by the plurality of pillar members spaced apart from each other, the entire sole structure can be made lighter in weight.

Also, in this case, the wavy corrugated plate is provided at the heel portion of the sole structure and amplitudes of the corrugations of the wavy corrugated plate are gradually greater toward the heel circumferential edge side. As a result, even in the case where a heel of a wearer's foot is about to pronate or supinate to lean laterally at the time of heel strike onto the ground, compressive deformation of the wavy corrugated plate is harder to occur toward the heel circumferential edge side of the wavy corrugated plate. Therefore, lateral leaning or swing of the heel of the foot can be securely prevented from occurring thus improving stability at the time of heel strike onto the ground.

Moreover, in this case, since the corrugations are not formed at the heel central portion of the wavy corrugated plate, the heel central portion easily deforms downwardly when a compressive load is applied to the heel central portion of the wavy corrugated plate at the time of heel strike onto the ground. At this juncture, the heel circumferential edge portions of the bottom surface of the wavy corrugated plate are sustained by the plurality of pillar members. Thereby, the compressive load acts onto the top surfaces of the pillar members on the heel central side and causes the heel central portion to compressively deform to generate the moment to rotate the pillar members around the edge portions of the bottom surfaces of the pillar members on the heel central side.

Due to the action of this moment, the top surfaces of the pillar members on the heel circumferential side are going to move upwardly. However, at this juncture, the top surfaces of the pillar members on the heel circumferential side press against the corrugations formed on the bottom surface of the wavy corrugated plate on the heel circumferential side. The action of the corrugations generates the inverted moment opposite the above-mentioned moment.

As a result, at the time of heel impact onto the ground, the upward motion of the top surfaces of the pillar members on the heel circumferential side is restrained, thereby preventing the heel central portion of the wavy corrugated plate from sinking downwardly and generating the high resilience.

The ridge lines of the corrugations of the wavy corrugated plate may extend radially from the heel central portion to the heel circumferential portion.

In this case, the ridge lines of the corrugations of the wavy corrugated plate are disposed in the direction away from the round regions of high foot pressure (see FIGS. 9 and 10) of the heel central portion at the time of heel impact onto the ground. Thereby, leaning or rolling of the heel portion at the time of heel impact onto the ground can be effectively prevented and the heel portion can be stably supported.

The extended lines of the ridge lines toward the inside of the sole may pass through a region encircled by a circle with a center located at the position of 0.15 L from the heel rear end on the heel central line and with a radius of 0.05 L (L: length size of the shoe).

In this case, the above-mentioned encircled region generally corresponds to the heel central region of high foot pressure at the time of heel impact onto the ground. Therefore, in this case as well, the ridge lines of the corrugations of the wavy corrugated plate are disposed in the direction away from the round regions of high foot pressure of the heel central portion at the time of heel impact onto the ground. Thereby, leaning or rolling of the heel portion at the time of heel impact onto the ground can be effectively prevented and the heel portion can be stably supported.

The pillar members may be disposed so as to encompass the region on the outside of the region.

In this case, each of the pillar members can support the region of high foot pressure generally equally and stably.

The pillar members may be disposed at the downwardly convexed portions of the corrugations of the wavy corrugated plate on the bottom surface of the wavy corrugated plate.

In this case, when the top surfaces of the pillar members on the heel circumferential side is going to be lifted upwardly by the moment due to the compressive load acting on the heel central portion at the time of heel impact onto the ground, the top surfaces of the pillar members on the heel circumferential side press against the downwardly convexed portions of the corrugations of the wavy corrugated plate on the bottom surface. Then, since the downwardly convexed portions of the corrugations are least deformable, that is, they have high compressive hardness, they generate a great inverted moment relative to the pillar members. Thereby, at the time of heel impact onto the ground, the top surfaces of the pillar members on the heel circumferential side can be restrained from moving upwardly and much higher resilience can be generated.

The heel central portion of the wavy corrugated plate may be planar in shape.

In this case, at the time of heel impact onto the ground, a downward deformation of the heel central portion of the wavy corrugated plate can be easily conducted.

The heel central portion of the wavy corrugated plate may have a through hole extending in the longitudinal direction and having an elongated aperture.

In this case, at the time of heel impact onto the ground, a downward deformation of the heel central portion of the wavy corrugated plate can be more easily conducted.

A midsole formed of soft elastic materials may be disposed on the upper surface of the wavy corrugated plate.

In this case, a foot contact feeling of a shoe wearer can be improved.

The pillar members may be gradually greater in width from the heel central portion to the heel circumferential portion.

In this case, an area of the top surfaces of the pillar members is smaller on the heel central side and larger on the heel circumferential side. Thereby, the heel central side is easier to deform compressively.

The pillar members may be formed of a first pillar member disposed at the heel rear end portion, a second pillar member disposed at the heel lateral side edge portion, and a third pillar member disposed at the heel medial side edge portion.

In this case, the compressive load generated at the time of heel impact onto the ground can be stably supported by the least pillar members.

The heel central side portion of each of the pillar members may be coupled to each other in a U-shape through plate-like connections.

In this case, since a plurality of pillar members are integrated with each other, mis-assembly or misalignment of the pillar members can be prevented. Also, by connecting the pillar members in a U-shape, the rigidity of the heel central portion can be adjusted delicately.

The connections may project in a flanged shape over the inside surfaces on the heel central side of the pillar members toward the heel central portion.

In this case, when the compressive load acts on the projections in a flanged shape at the time of heel impact onto the ground, the point of action of the compressive load is spaced away from the inside surfaces of the pillar members on the heel central side and thus the rotational moment on the bottom surfaces of the pillar members around the edge portions on the heel central side is easy to occur.

Each of the bottom surfaces of the pillar members may be coupled to each other in the longitudinal direction through the resin-made plate.

That is, in this case, the pillar members are sandwiched between the wavy corrugated plate and the resin-made plate. Thereby, at the time of heel impact onto the ground, the load applied from the ground contact surface can be dispersed to each of the pillar members through the resin-made plate.

A lower surface of an outsole region that corresponds to a plate region supporting the bottom surfaces of the pillar members may be disposed at a position higher than, i.e. recessed above, the ground contact surface of the outsole.

In this case, the reaction force acting on the outsole from the ground at the time of heel impact onto the ground is applied to the outsole ground contact surface apart from the position directly under the pillar members and thereafter the force is dispersed to each of the pillar members. As a result, a press feeling against the foot of the wearer received from the pillar members at the time of heel strike onto the ground can be relieved. Also, in this case, the outsole portion directly under the pillar member is located above the outsole ground contact surface. Thereby, when the compressive load is applied to the outsole ground contact surface at the time of heel impact onto the ground, the outsole portion located above the outsole ground contact surface is easy to elongate thus improving cushioning properties at the time of heel impact onto the ground.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
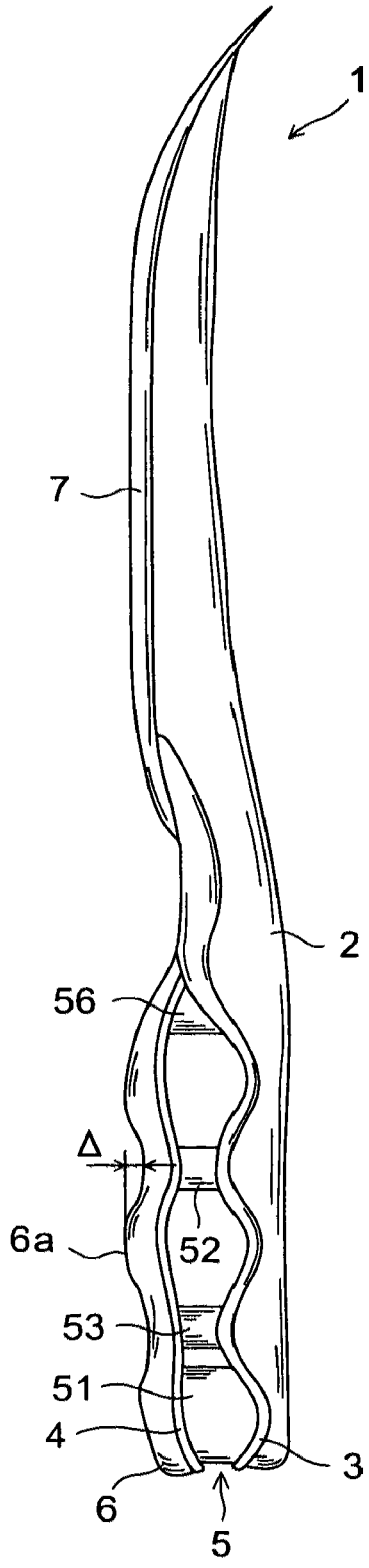
FIG. 1 is a side view on the lateral side of a sole structure according to an embodiment of the present invention.
Figure 2:
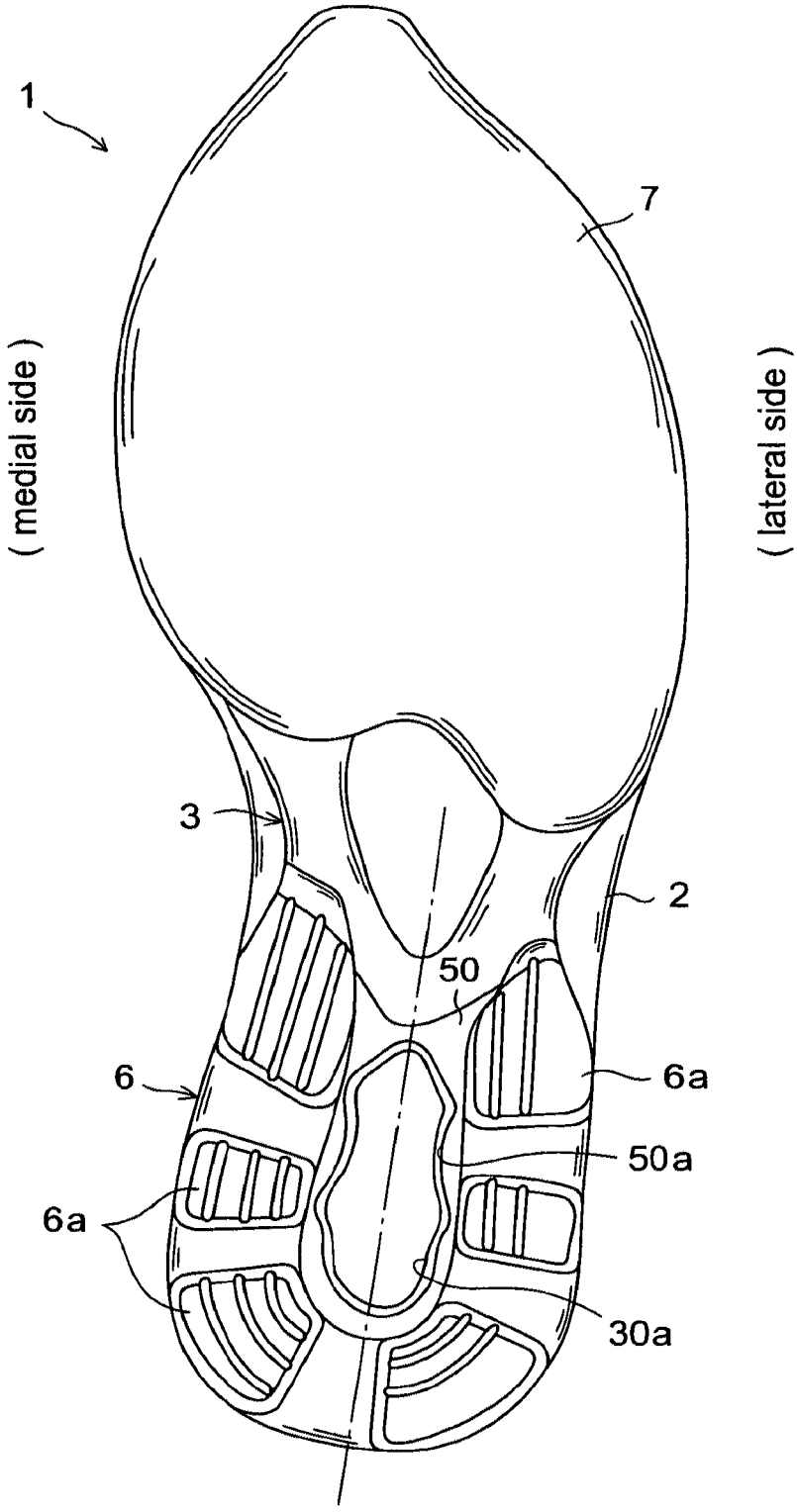
FIG. 2 is a bottom schematic view of the sole structure of FIG. 1.

Referring now to the drawings, FIGS. 1 and 2 show a sole structure or a sole assembly for a sports shoe according to an embodiment of the present invention. As shown in FIGS. 1 and 2, a sole structure 1 includes a midsole 2 formed of a soft elastic material, extending along the entire length of a shoe, and disposed on the foot sole side of a shoe wearer, a resin-made wavy corrugated plate 3 extending from the heel region to the midfoot region on the lower surface of the midsole 2 and having corrugations at least at the heel region, a resin-made plate 4 disposed opposite and spaced away downwardly from the corrugations of the wavy corrugated plate 3, a pillar member unit 5 composed of a plurality of pillar members 51-57 (only a portion of them are shown in FIG. 1) that are sandwiched between the wavy corrugated plate 3 and the plate 4, a rubber-made outsole 6 attached to the lower surface of the plate 4, and a rubber-made outsole 7 attached to the lower surface of the forefoot region of the midsole 2. Midsole 2, wavy corrugated plate 3, plate 4, pillar member unit 5, and outsoles 6, 7 are fixedly attached to each other via a bond or the like.

Figure 3:
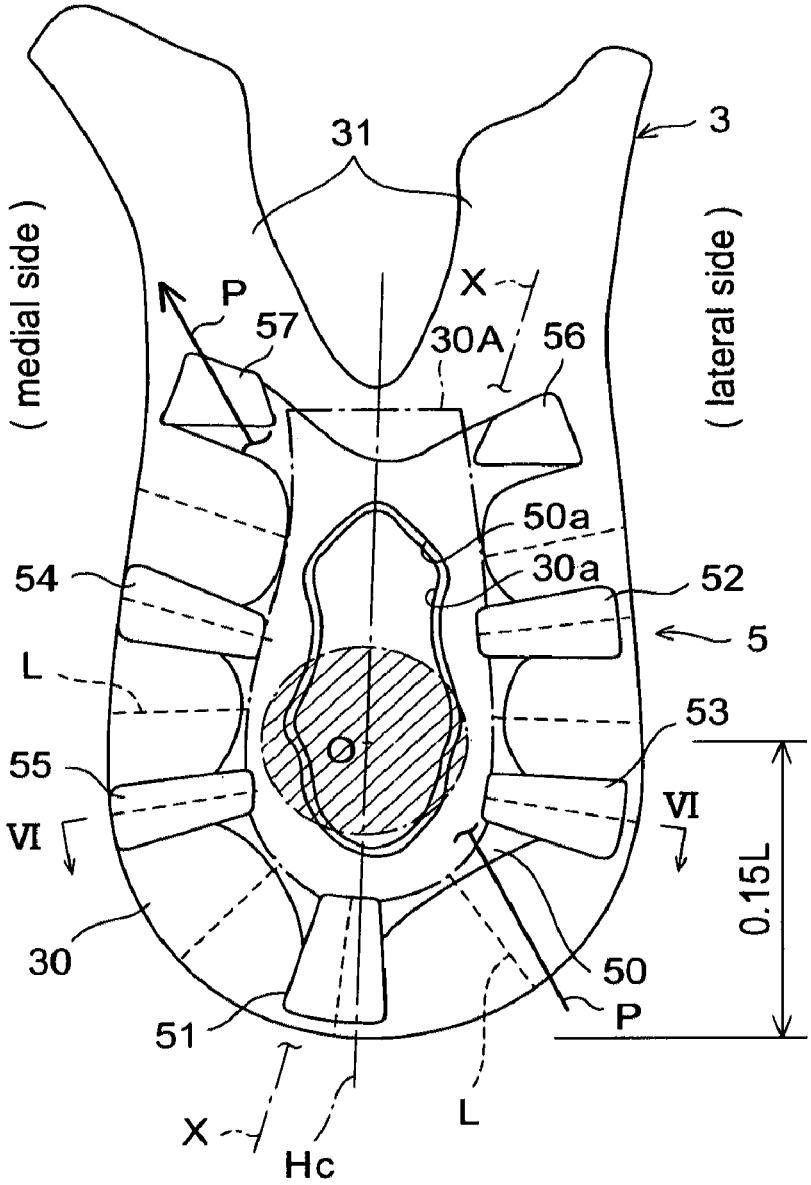
FIG. 3 is a bottom view of the wavy corrugated plate and the pillar member unit constituting the sole structure of FIG. 1.

As shown in FIG. 3, the wavy corrugated plate 3 has a heel region 30 with a through hole 30*a* formed in the central portion of the heel region 30 and extending in the longitudinal direction as an elongated aperture, and a bifurcated midfoot region 31 formed integrally with the fore end of the heel region 30.

In FIG. 3, a dotted line L indicates a ridge line (i.e. crest line or trough line) of the corrugations formed at the heel region 30. The corrugations of the wavy corrugated plate 3 extend in a U-shape along the circumferential edge portions of the heel region 30. That is, the crest lines of the ridge lines L of the corrugations alternate with the trough lines of the ridge lines L of the corrugations along the circumferential edge portion of the heel region 30.

The ridge lines L of the corrugations of the wavy corrugated plate 3 extend radially from the heel central portion to the heel circumferential portion. That is for the purpose of effectively preventing the heel portion from leaning after heel impact onto the ground to improve heel stability. More specifically, the extended lines of the ridge lines L except the one at the foremost end pass through the region (hatched region in FIG. 3) encircled by a circle with a center O located at the position of 0.15 L (L: shoe's length size) from the heel rear end along the heel centerline Hc and a radius of 0.05 L.

Figure 9A:
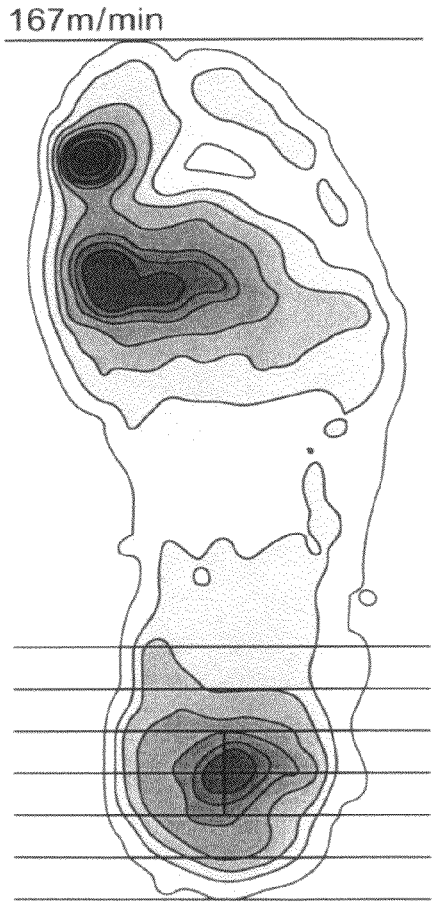
FIG. 9A is a foot pressure diagram during running at the rate of 167 m/min.
Figure 9B:
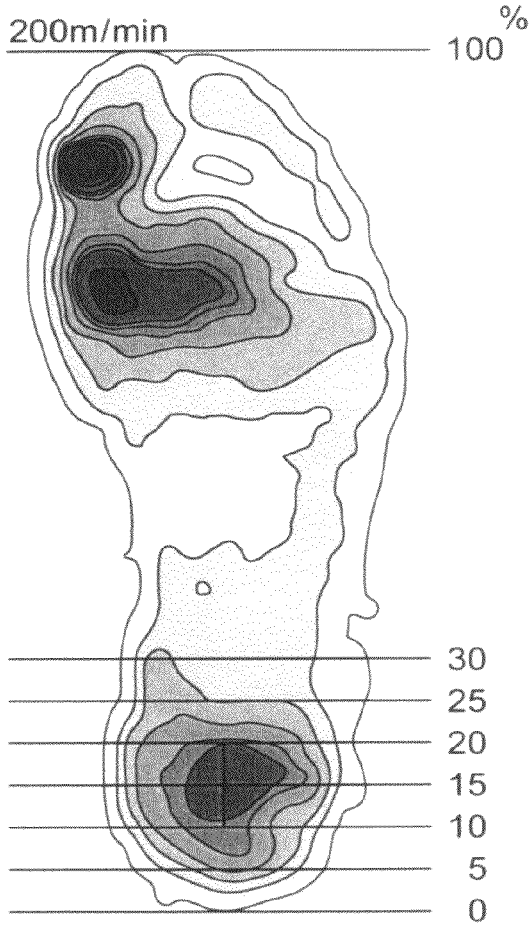
FIG. 9B is a foot pressure diagram during running at the rate of 200 m/min.
Figure 10A:
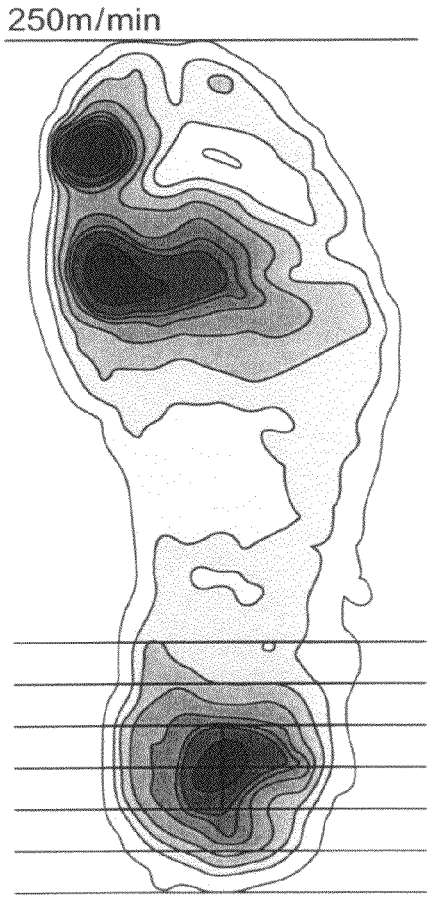
FIG. 10A is a foot pressure diagram during running at the rate of 250 m/min.
Figure 10B:
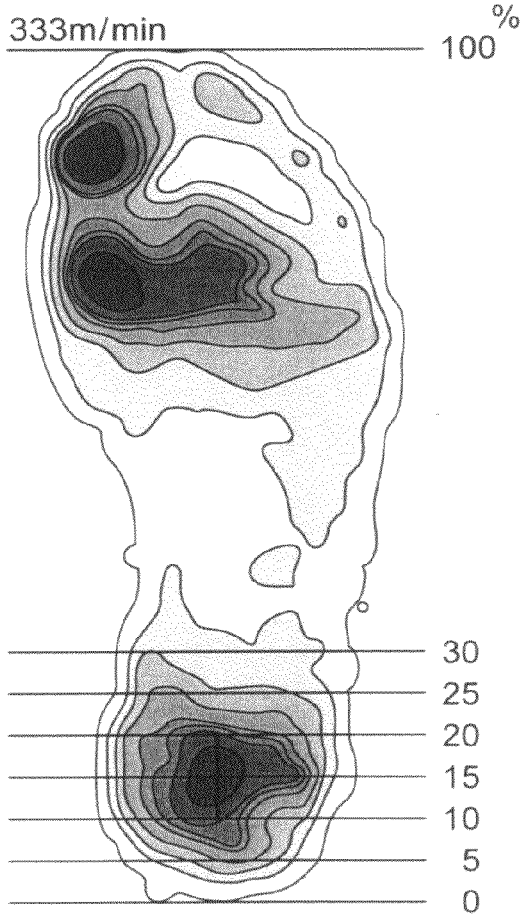
FIG. 10B is a foot pressure diagram during running at the rate of 333 m/min.

The encircled region is determined based on the foot pressure applied on the heel portion of a shoe during running. FIGS. 9 and 10 illustrate actual foot pressure distributions applied to the sole of a shoe during running. In FIGS. 9 and 10, contours located more inside the shoe indicate higher foot pressures. FIG. 9A shows the case of running at the rate of 167 m/min; FIG. 9B shows the case of running at the rate of 200 m/min; FIG. 10A shows the case of running at the rate of 250 m/min; and FIG. 10B shows the case of running at the rate of 333 m/min. In the drawings, numerals at the right end indicate the distance from the heel rear end in the case where shoe's length size is 100.

As can be seen from FIGS. 9 and 10, the maximum foot pressure that occurs at the heel portion of the shoe during running is located at the region encircled by a circle with a center at the position of 15% from the heel rear end at the heel central portion and a radius of 5%. In other words, the maximum foot pressure of the heel portion is located at the region encircled by a circle with a center at the position of 0.15 L from the heel rear end along the heel centerline Hc and a radius of 0.05 L.

Turning back to FIG. 3, at the central portion of the heel region 30, a planar heel central portion 30A is formed around the through hole 30*a*. Amplitudes of the corrugations of the wavy corrugated plate 3 are gradually greater toward the heel circumferential edge side. That is, at the heel central edge Portion where the corrugations adjoin the heel central portion 30A of the wavy corrugated plate 3, the amplitude of the corrugations is zero, but from here toward the heel circumferential edge side, the amplitude of the corrugations becomes gradually greater.

In addition, a mesh material such as nylon may be attached to the region corresponding to the opening portion of the through hole 30*a* of the wavy corrugated plate 3 on the bottom surface of the midsole 2. That is for the purpose of preventing fatigue of a wearer's foot due to excessive sinking or downward movement of the calcaneus. Because the through hole 30*a* formed at the heel central portion of the wavy corrugated plate 3 causes the heel central portion of the midsole 2 to deform downwardly excessively. The mesh material helps to restrain such downward deformation.

Figure 4:
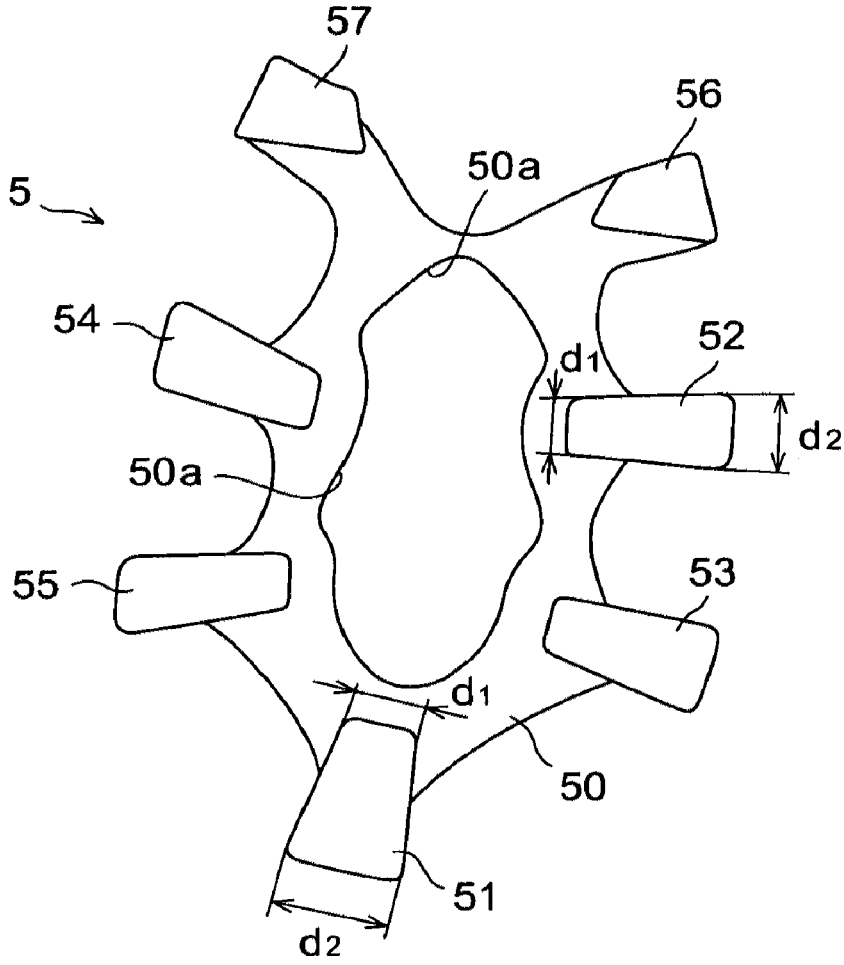
FIG. 4 is a bottom view of the pillar member unit of FIG. 3.
Figure 5:
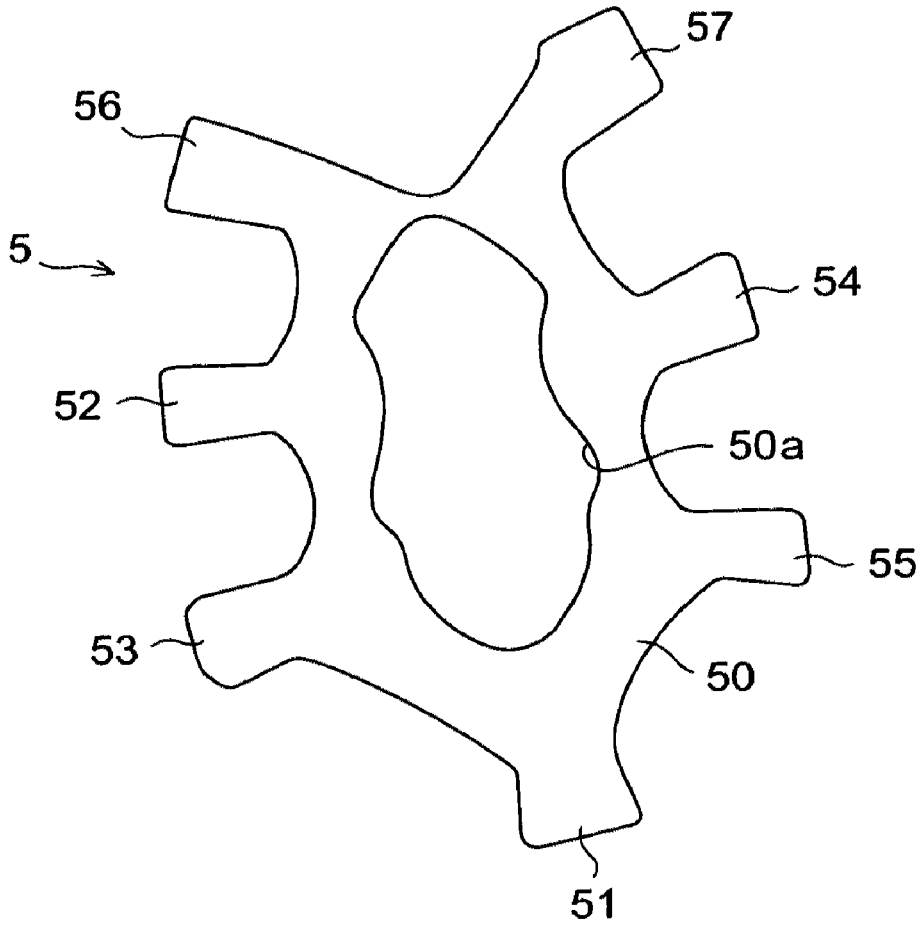
FIG. 5 is a top plan view of the pillar member unit of FIG. 3.

As shown in FIGS. 4 and 5, the pillar member unit 5 is composed of a plurality of pillar members 51-57 of elastic materials spaced apart from each other and a connection plate 50 connecting each of the pillar members 51-57 and having a central through hole 50*a* elongated in the longitudinal direction.

Of all the pillar members 51-57, the pillar members 51-55 are disposed along the heel circumferential portion of the heel region. That is, a first pillar member 51 is disposed at the heel rear end edge portion, second pillar members 52, 53 at the heel lateral side edge portion, and third pillar members 54, 55 at the heel medial side edge portion. Each of the pillar members 51-55 is located outside the above-mentioned circle region with a center of point 0 so as to circumscribe the circle region. That is for the purpose of supporting stably and generally equally the circle region of high foot pressure at the time of heel impact onto the ground. In addition, the pillar members 56, 57 are disposed at the midfoot region (see FIG. 3).

Each of the pillar members 51-55 has a generally trapezoidal shape viewed from the bottom side or in horizontal section. The width $d_1$ of the heel central side portion is smaller than the width $d_2$ of the heel circumferential side portion and the width is gradually greater from the heel central side to the heel circumferential side. That is for the purpose of causing a compressive deformation to easily occur at the heel central side when the compressive load applies to the pillar member unit 5.

Figure 6:
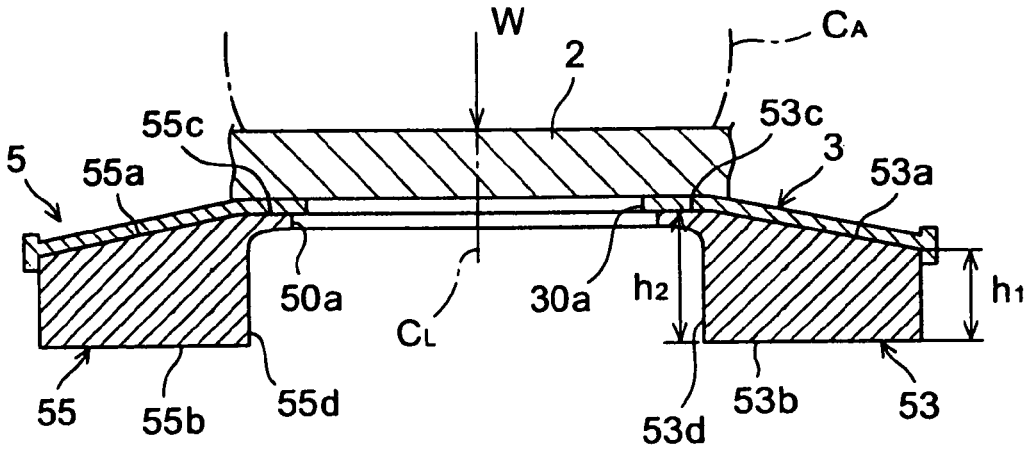
FIG. 6 is a cross sectional view of FIG. 3 taken along line VI-VI and also shows the midsole.

Also, each of the pillar members 51-55 has a generally trapezoidal shape viewed from the side or in longitudinal section. The height of the heel central side portion is greater than the height of the heel circumferential side portion and the height is gradually smaller from the heel central side to the heel circumferential side. That is, as shown in FIG. 6 corresponding to a cross sectional view along line VI-VI of FIG. 3, to take an example, the pillar member 53 (as with the pillar member 55) has a top surface 53*a* that inclines downwardly from the heel central side to the heel circumferential edge side. The height of the inclined top surface 53*a* from a planar bottom surface 53*b* satisfies an inequality, $h_2>h_1$ wherein $h_2$ is a height of the heel central side and $h_1$ is a height of the heel circumferential edge side.

In addition, on the heel central side from the top surface of each of the pillar members 51-55, a horizontal non-inclined planar surface (e.g. 53*c*, 55*c* for the pillar members 53, 55) is formed.

The bottom surfaces of the corrugations of the wavy corrugated plate 3 are in contact with each of the top surfaces of the pillar members 51-55. Specifically, each of the pillar members 51-55 is respectively located at the position corresponding to a respective one of the trough lines L of the ridge lines L of the corrugations of the wavy corrugated plate 3, i.e. at a downwardly convexed position of the corrugations (see FIGS. 1 and 3).

The connection plate 50 couples the heel central side portion of each of the pillar members 51-57. Such connection plate 50 unites the plural pillar members 51-57 into a single unit, thus preventing mis-assembly or misalignment of the individual pillar members. Also, the connection plate 50 may extend over the inside surface (e.g. 53*d*, 55*d* for the pillar members 53, 55) of the heel central side portion of each of the pillar members toward the heel central side. The extended portion of the connection plate 50 may be in a flange shape. In this case, at the time of heel impact onto the ground, when the compressive load acts on the extended flange portion of the connection plate 50, the point of action of the compressive load is spaced further away from the inside surface of the heel central side portion of each of the pillar members. Thereby, the rotational moment easily occurs around the edge portion of the heel central side portion under the bottom surface of each of the pillar members.

The plate 4 extends in a U-shape connecting each of the pillar members 51-57. The outsole 6 disposed under the plate 4 similarly extends in a U-shape. Also, the bottom surface of a portion of the outsole 6 corresponding to the support region of the plate 4 that supports the bottom surface of each of the pillar members is disposed a distance Δ upwardly from the ground contact surface 6*a* of the outsole 6 (see FIG. 1). The distance Δ is determined at preferably 2 mm or more.

The midsole 2 is preferably formed of a soft elastic member having good cushioning properties. For example, foamed thermoplastic resin such as ethylene-vinyl acetate copolymer (EVA), foamed thermosetting resin such as polyurethane (PU), and foamed rubber such as butadiene rubber or chloroprene rubber may be used.

Each of the pillar members 51-57 is preferably formed of rubber. In the alternative, it may be formed of elastic materials such as urethane, ethylene-vinyl acetate copolymer (EVA), or polyamide elastomer (PAE). The elastic materials preferably have a hardness of 50 (A)-80 (A) at A scale of JIS (Japanese Industrial Standards). That is because when the hardness is more than 80 (A) the stability of the sole structure is enhanced but the cushioning properties are deteriorated whereas when the hardness is less than 50 (A) the cushioning properties are improved but the stability is deteriorated. Also, for an advantage of using rubber, it improves durability of the performance.

The wavy corrugated plate 3 and the plate 4 may be formed of thermoplastic resin such as thermo plastic polyurethane (TPU), polyamide elastomer (PAE), ABS resin or the like. Alternatively, the wavy corrugated plate 3 and the plate 4 may be formed of thermosetting resin such as epoxy resin, unsaturated polyester resin or the like. Also, the wavy corrugated plate 3 and the plate 4 may be formed of rubber, EVA, cloth or the like. When using cloth it is preferably attached to for example, the midsole 2 or outsole 6 by laminating, heat fusion or bonding in order to enhance rigidity.

Figure 7:
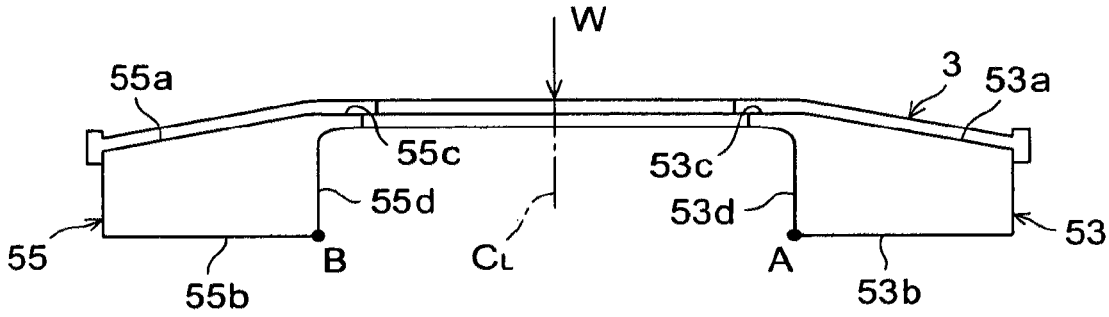
FIG. 7 is a schematic illustrating the action and effect of the embodiment of the present invention and corresponding to FIG. 6 without a midsole.

Turning to the operations of the embodiment of the present invention, as shown in FIG. 6, at the time of heel impact onto the ground, compressive load W is applied to the sole structure from the calcaneus $C_A$ via the midsole 2. At this juncture, the action line of the compressive load W is disposed on the lateral centerline $C_L$ of the sole structure composed of the wavy corrugated plate 3 and the pillar member unit 5 (see FIG. 7). In FIG. 7, midsole 2 of FIG. 6 is omitted for simplicity.

Figure 8:
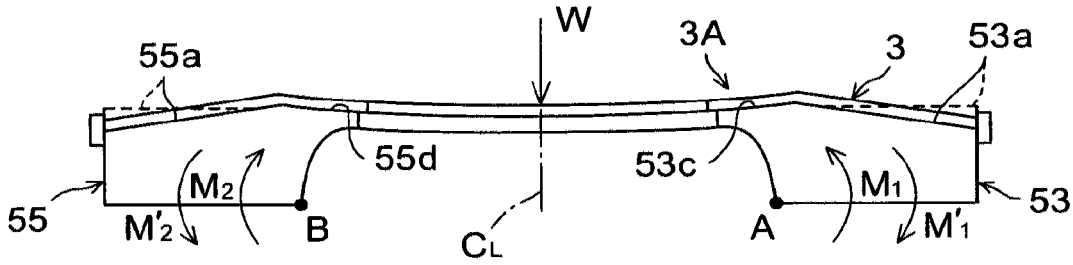
FIG. 8 is a schematic illustrating the action and effect of the embodiment of the present invention.

Here, the heel central portion 30A of the wavy corrugated plate 3 is not corrugated but planar and besides it has a through hole 30*a*. Due to the action of the compressive load W, as shown in FIG. 8, the heel central portion 30A easily deforms downwardly and thus the pillar members deforms compressively. Also, due to the action of the compressive load W, moment $M_1$ in the counterclockwise direction in FIG. 8 occurs around the corner A, and moment $M_2$ in the clockwise direction in FIG. 8 occurs around the corner B.

Through the moments $M_1$ and $M_2$, the heel circumferential side portions of the top surfaces 53*a*, 55*a* of the pillar members 53, 55 are going to be lifted upwardly (see the dotted lines in FIG. 8). However, at this juncture, the top surfaces 53*a*, 55*a* of the pillar members 53, 55 on the heel circumferential side come into tight contact with the corrugations provided at the heel circumferential portion on the bottom surface of the wavy corrugated plate 3. Due to the reaction force from the corrugations, moments $M_1'$, $M_2'$, which are inverted or opposite relative to moments $M_1$, $M_2$ and have the same magnitude as moments $M_1$, $M_2$, occur around the corners A, B, respectively.

As a result, at the time of heel impact onto the ground, upward movement of the top surface of each of the pillar members on the heel circumferential side is restrained. Thereby, downward movement or sinking of the heel central portion of the wavy corrugated plate 3 can be restricted and high reaction force can be generated.

Moreover, in this case, since the top surfaces 53*a*, 55*a* of each of the pillar members 53, 55 are inclined or gradually lowered relative to the bottom surfaces toward the heel circumferential side, a great reaction force can be achieved from the corrugations of the wavy corrugated plate 3 at the time of generation of the inverted moments $M_1'$, $M_2'$.

Figure 8A:
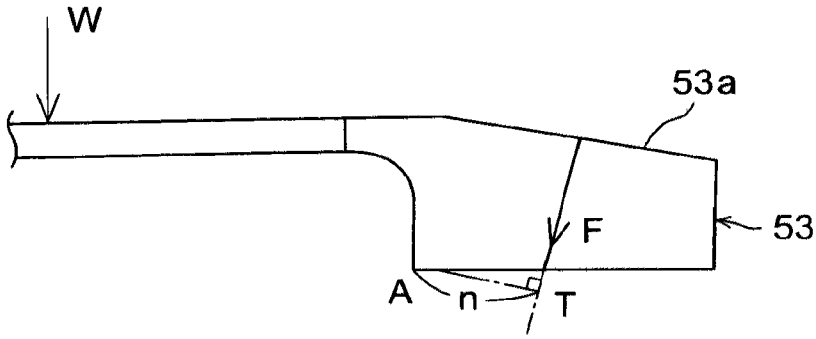
FIG. 8A is a schematic illustrating the action and effect of the embodiment of the present invention showing the size of the reaction from the corrugations.
Figure 8B:
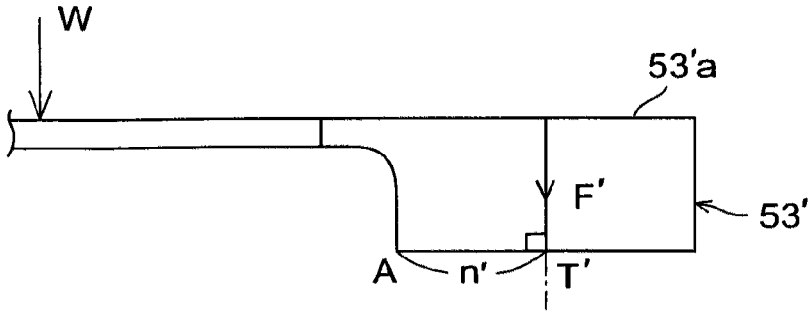
FIG. 8B is a schematic showing a comparative example of FIG. 8A.

That feature will now be explained with reference to FIGS. 8A and 8B. FIG. 8A is an enlarged view of the pillar member 53 of FIG. 8 showing the reaction force F received by the inclined surface 53*a* of the pillar member 53 from the adjoining corrugation of the wavy corrugated plate 3 at the time of generation of moment $M_1$. FIG. 8B illustrates a comparative example of FIG. 8A showing the reaction force F' received by a comparative planar surface 53'*a* of a comparative pillar member 53' from the wavy corrugated plate 3 at the time of generation of moment $M_1$ in the case where the top surface of the pillar member 53' is a non-inclined planar surface 53'*a*.

In FIG. 8A, when a perpendicular line AT is drawn from the corner A to the line of action of the reaction force F, the following equality is satisfied:

$$M_1'=F\cdot n \quad (1)$$

Where n is a length of the line segment AT.

On the other hand, in FIG. 8B, when the line of action of the reaction force F' intersects the bottom surface of the pillar member 53' at point T'. The following equality is satisfied:

$$M_1'=F'\cdot n' \quad (2)$$

Where n' is a length of the line segment AT'.

Here, n'>n therefore, from equations (1) and (2), the following inequality is satisfied:

$$F>F'$$

Consequently, the reaction force received from the corrugations in the case of inclined surface 53*a* (FIG. 8A) becomes greater than that in the case of the planar surface (FIG. 8B). That is also applicable to the case of the pillar member 55.

Also, in this case, since the top surfaces 53*a*, 55*a* of the pillar members 53, 55 are gradually lowered toward the heel circumferential edge side, each of the pillar members 53, 55 is lighter in weight compared with the pillar members with planar top surfaces.

Figure 11:
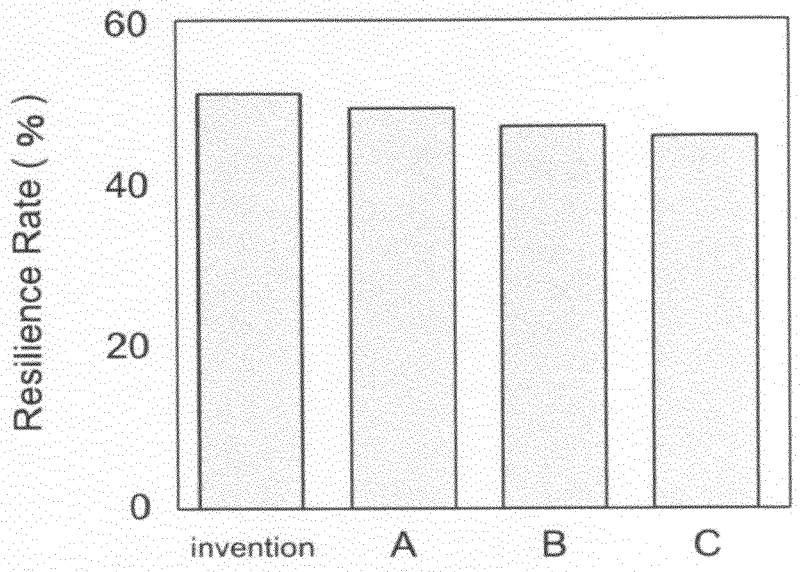
FIG. 11 is a graph showing the result of the weight fall test, illustrating the resilience ratio of the sole structure of the present invention shown in FIG. 1 in comparison with the resilience ratios of samples A to C.
Figure 12:
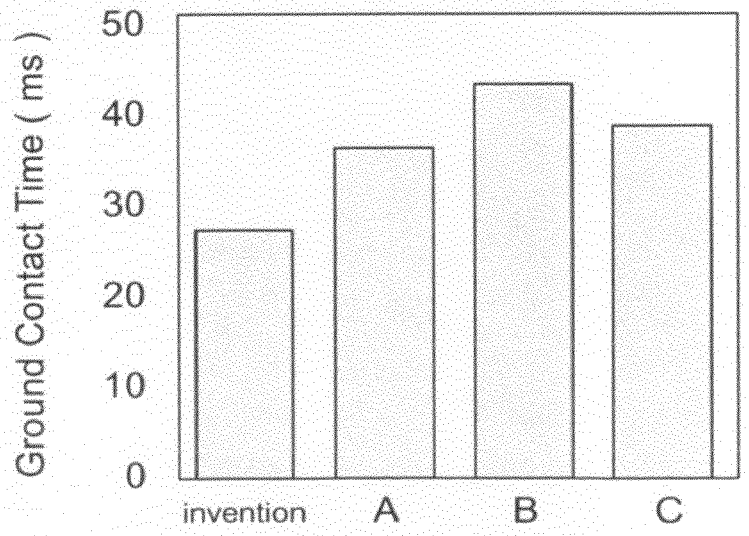
FIG. 12 is a graph showing the result of the weight fall test, illustrating the ground contact time of the sole structure of the present invention in comparison with the ground contact time of samples A to C.
Figure 13:
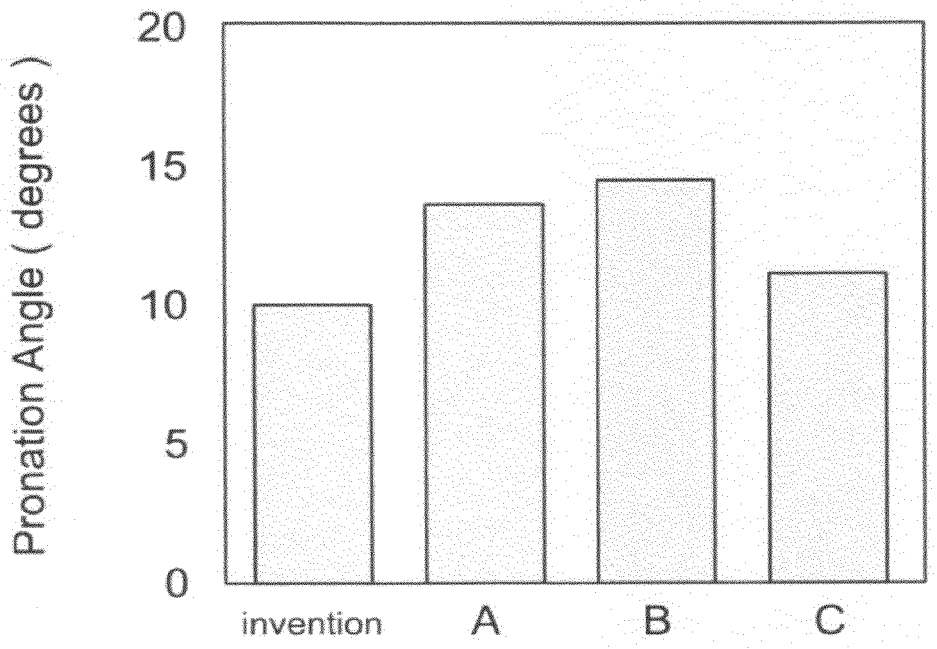
FIG. 13 is a graph showing the pronation angle during running with a shoe of the present invention in comparison with the pronation angles of samples A to C.

FIGS. 11 to 13 illustrate the results of the experiments showing the resilience ratio, ground contact time, and pronation angle of the sole structure of the present embodiment.

In each of the experiments, the details of the article of the present invention, and sample A, B, C as comparative examples are shown below:

i) Invention; A sole structure of the present invention having a rubber-made pillar member unit 5 (rubber hardness: 60 (A)) sandwiched between the resin-made wavy corrugated plate 3 and the plate 4.

ii) Sample A; A sole structure composed of EVA midsole.

iii) Sample B; A sole structure having an air cushioning member interposed in the EVA midsole.

iv) Sample C; A sole structure having a wave plate interposed in the EVA midsole.

Also, details of the items measured in each of the experiments are shown as follows:

a) Resilience Ratio; The value of the reaction force from the ground divided by the force applied to the ground when a weight of 10 kg in weight and 45 mm in diameter of the ground contact surface falls onto each of the sole structures from the height of 60 mm.

b) Ground Contact Time; Time period during contact state of the weight with each of the sole structures (i.e. on-to-off time) when the weight of 10 kg in weight and 45 mm in diameter of the ground contact surface falls onto each of the sole structures from the height of 60 mm.

c) Pronation Angle; Average of angles of the heel portion relative to the calf (i.e. angle of swing of the heel portion in the lateral direction) when a shoe wearer or a testee runs on a treadmill for one minute with the shoes composed of each of the sole structures.

As can be seen from the graph of FIG. 11, the article of the present invention has a higher resilience rate than any of the samples A, B, C and therefore it generates a high reaction force against the applied load. Also, as can be seen from the graph of FIG. 12, the article of the present invention has a shorter ground contact time than any of the samples A, B, C. Moreover, as can be seen from the graph of FIG. 13, the article of the present invention has a smaller pronation angle than any of the samples A, B, C. Therefore, in the article of the present invention, leaning of the heel portion during running is smallest.

Accordingly, it has been proved that the article of the present invention can achieve the high resilience and at the same time it is superior in the heel stability at the time of heel impact onto the ground.

Also, according to the present embodiment, since the bottom surface of the wavy corrugated plate 3 is supported not by the midsole of a soft elastic material attached to the entire surface of this bottom surface but by the plural pillar members 51-57 spaced apart from each other, the entire sole structure can be made lighter in weight.

Moreover, since the wavy corrugated plate 3 is provided at the heel region of the sole structure and the amplitudes of the corrugations of the wavy corrugated plate 3 are gradually greater toward the heel circumferential edge side, even in the case where the heel of a shoe wearer's foot is about to pronate or supinate to lean toward the lateral side at the time of heel impact onto the ground, compressive deformation is harder to occur toward the heel circumferential side of the wavy corrugated plate 3. As a result, lateral deformation or leaning sideways of the heel portion can be securely prevented, thus improving the stability at the time of heel impact onto the ground.

Furthermore, according to the present embodiment, since the plural pillar members are disposed along the heel circumferential portion, the pillar member 57 can be located in the acceleration direction of pronation designated by the arrow mark P in FIG. 3. By so doing, pronation can be restrained. Also, the pillar member 51 can be located on the extended line X of the major axis of the calcaneus thereby preventing rotation of the heel on the sagittal plane.

In addition, according to the present embodiment, the bottom surface of the outsole 6 corresponding to the support portion of the plate 4 that supports the bottom surfaces of the pillar members 51-55 is spaced the distance of Δ upwardly apart from the ground contact surface 6*a* of the outsole 6. Therefore, the reaction force applied to the outsole 6 from the ground at the time of heel impact onto the ground acts on the ground contact surface 6*a* of the outsole 6 and there after it is dispersed into each of the pillar members 51-57. Thereby, a press feeling against the foot received from the pillar members 51-55 at the time of heel impact onto the ground can be relieved.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

a wavy corrugated plate that is disposed at least at a heel region of said sole structure and that includes corrugations extending outwardly from a heel central portion through a heel circumferential portion of said sole structure along a heel circumferential edge of said heel region; and a plurality of pillar members that are formed of elastic material and that are disposed at said heel circumferential portion below said wavy corrugated plate, wherein each of said pillar members has a top surface, each top surface comprises an inclined surface that slopes downwardly as said inclined surface respectively progresses outwardly away from said heel central portion toward said heel circumferential edge of said sole structure;

wherein a respective amplitude, in a vertical height direction, of a respective one of said corrugations increases as said respective corrugation progresses outwardly toward said heel circumferential edge from said heel central portion;

wherein said wavy corrugated plate further includes a non-corrugated flat plate portion at said heel central portion, said corrugations adjoin said flat plate portion at which said respective amplitude is zero, and said corrugations include upwardly convex corrugations protruding upwardly beyond a plane of said flat plate portion and downwardly convex corrugations protruding downwardly beyond a plane of said flat plate portion.

2. The sole structure according to claim 1, wherein said corrugations of said wavy corrugated plate respectively extend along corrugation ridge lines oriented radially from said heel central portion to said heel circumferential edge.

3. The sole structure according to claim 2, wherein imaginary radially inward extensions of said ridge lines pass through a reference region encircled by an imaginary reference circle having a radius of 0.05L and having a center located at a position 0.15L from a rear end of said heel region along a longitudinal heel centerline of said heel region, wherein L is a length size of the shoe.

4. The sole structure according to claim 3, wherein said pillar members are disposed outside of said reference region around said reference region.

5. The sole structure according to claim 1, wherein said pillar members are disposed below said wavy corrugated plate respectively at said downwardly convex corrugations of said wavy corrugated plate.

6. The sole structure according to claim 1, wherein said non-corrugated flat plate portion is a planar portion of said sole structure.

7. The sole structure according to claim 1, wherein at said heel central portion, said wavy corrugated plate has a through hole with an elongated hole shape that is elongated in a longitudinal direction of said sole structure.

8. The sole structure according to claim 1, further comprising a midsole formed of soft elastic material disposed on an upper surface of said wavy corrugated plate.

9. The sole structure according to claim 1, wherein each of said pillar members has a horizontal sectional shape that becomes progressively wider from said heel central portion to said heel circumferential portion.

10. The sole structure according to claim 1, wherein each of said pillar members has a vertical sectional shape and a horizontal sectional shape that are respectively generally trapezoidal shapes.

11. The sole structure according to claim 1, wherein said pillar members comprise a first pillar member disposed at a heel rear end of said heel circumferential portion, a second pillar member disposed at a heel lateral side edge of said heel circumferential portion, and a third pillar member disposed at a heel medial side edge of said heel circumferential portion.

12. The sole structure according to claim 1, further comprising plate-like connection elements that extend from respective portions of said pillar members oriented toward said heel central portion and that interconnect said pillar members with one another.

13. The sole structure according to claim 12, wherein said plate-like connection elements project from said pillar members inwardly toward said heel central portion and together form a flange-shaped connection plate with a U-shape on respective sides of said pillar members facing inwardly toward said heel central portion.

14. The sole structure according to claim 12, wherein said plate-like connection elements project from respective upper portions of said pillar members adjoining said top surfaces of said pillar members, and said pillar members protrude downwardly from said plate-like connection elements.

15. The sole structure according to claim 12, wherein said plate-like connection elements are formed integrally as one-piece with said pillar members, whereby said plate-like connection elements and said pillar members together form a pillar member unit.

16. The sole structure according to claim 1, further comprising a sole plate that is made of resin and that couples respective bottom surfaces of said pillar members with one another.

17. The sole structure according to claim 16, wherein said sole plate has a U-shape.

18. The sole structure according to claim 16, further comprising an outsole that is provided on a bottom surface of said sole plate and that has a downwardly exposed outsole surface including lowermost ground contact surface areas.

19. The sole structure according to claim 18, wherein said downwardly exposed outsole surface further includes upwardly recessed surface areas that are respectively recessed upwardly relative to said lowermost ground contact surface areas, and that are respectively located vertically below at least some of said pillar members.

20. The sole structure according to claim 1, wherein said top surfaces of said pillar members are fixedly attached directly to a bottom surface of said wavy corrugated plate.

21. The sole structure according to claim 1, wherein said top surfaces of said pillar members respectively further comprise non-inclined horizontal planar surfaces respectively adjoining inner edges of said inclined surfaces toward said heel central portion.

22. The sole structure according to claim 1, wherein a forwardmost one of said pillar members is located on a medial side of said sole structure along a pronation acceleration direction line of pronation of a foot of a person wearing said shoe, wherein said pronation acceleration direction line extends from a lateral side of said heel circumferential edge through said heel central portion to said medial side at a midfoot region of said sole structure, and wherein a rearmost one of said pillar members is located at a rear end of said heel circumferential portion along an extension line of a major axis of a calcaneus of the foot of the person.

* * * * *